US007341049B2

(12) United States Patent
Clack

(10) Patent No.: US 7,341,049 B2
(45) Date of Patent: Mar. 11, 2008

(54) APPARATUS FOR IMPROVING EFFICIENCY AND EMISSIONS OF COMBUSTION

(76) Inventor: David M Clack, 2624 Malone Dr., Kansas City, KS (US) 66104

( * ) Notice: Subject to any disclaimer, the term of this patent is extended or adjusted under 35 U.S.C. 154(b) by 244 days.

(21) Appl. No.: 11/182,546

(22) Filed: Jul. 15, 2005

(65) Prior Publication Data

US 2007/0012300 A1 Jan. 18, 2007

(51) Int. Cl.
*F02M 27/00* (2006.01)

(52) U.S. Cl. ..... 123/539

(58) Field of Classification Search ..... 123/536–539
See application file for complete search history.

(56) References Cited

U.S. PATENT DOCUMENTS 1,982,484 A 11/1934 Runge ..... 123/119
4,308,844 A * 1/1982 Persinger ..... 123/539
4,519,357 A * 5/1985 McAllister ..... 123/539
5,010,869 A * 4/1991 Lee ..... 123/539
5,487,874 A 1/1996 Gibboney, Jr. ..... 422/186.03
6,463,917 B1 10/2002 Silver ..... 123/536
2005/0126550 A1* 6/2005 Varasundharosoth et al. ..... 123/539

* cited by examiner

*Primary Examiner*—Marguerite McMahon
(74) *Attorney, Agent, or Firm*—Martin & Associates, L.L.C.; Bret J. Petersen

(57) ABSTRACT

An apparatus increases the efficiency and emissions of a combustion process by producing sufficient amounts of ozone in the air flow to the combustion chamber to enable more complete and cleaner combustion of the fuel. Embodiments of the invention include a plurality of cell elements disposed within a housing that is in placed in the air intake to a combustion chamber such as a diesel engine. The plurality of cell elements create an electrical plasma field that produces ozone. Other embodiments include a scrubber in the housing to cause the air flow to have a vortex action to increase the amount of ozone that flows into the combustion chamber.

26 Claims, 4 Drawing Sheets

APPARATUS FOR IMPROVING EFFICIENCY AND EMISSIONS OF COMBUSTION

BACKGROUND OF THE INVENTION

1. Technical Field

This invention generally relates to combustion processes, and more specifically relates to an apparatus for improving the efficiency and emissions of a combustion process such as an internal combustion engine.

2. Background Art

It has been observed that automobiles run better after a thunderstorm. It is believed that this phenomenon is primarily caused by the natural conditions that exist after an electrical storm, namely, the presence of ozone and an increase in the relative amount of negative ions in the air. These conditions increase the efficiency of the internal combustion process by increasing the density of the air charge or the quantity of air supplied to the cylinder during a single cycle and increasing the ozone which contains more oxygen than diatomic oxygen. The combination of a denser air charge and more oxygen increases the cylinder pressure, which increases the engine torque and horsepower output. By increasing the engine's ability to do work, less fuel is used to perform the same work as an engine in a normal situation.

The conditions observed after a thunderstorm last for only a short period of time because the concentration of ozone following a thunderstorm is very small (about 1 part per billion (ppb)), and the relative imbalance of negative ions quickly reverts back to the usual positive:negative ion ratio at the earth's surface. For a short time after a thunderstorm, however, engines run more efficiently and use less gasoline.

Introduction of ozone into a combustion chamber like the conditions after a thunderstorm have been attempted to increase the efficiency of the combustion by increasing the amount of oxygen into the combustion for a given volume of air. Devices to add ozone gas and charged ions to a combustion mixture in an internal combustion engine have been described in the prior art. For example, in U.S. Pat. No. 1,982,484 issued to Runge, a distributor of an internal combustion engine is utilized to produce ozone gas which is then added to the combustion mixture flowing through an intake manifold of the engine. U.S. Pat. No. 4,308,844 to Persinger also describes improving the efficiency in an internal combustion engine by providing an ozone generator cell in the air supply to an engine. The ozone generator cell is a single tubular anode inside a tubular cathode that ionizes a relatively small volume of air to the engine.

FIG. 1 shows a prior art ozone generator used to enhance the efficiency of combustion. In FIG. 1, an ozone cell 110 is suitably disposed between the air intake 120 and a combustion chamber 130 to produce ozone and induce a charge in the air supply. In some prior art embodiments, the ozone cell incorporates a single flat plate for the cathode and a single flat plate for the anode, and in other embodiments, the ozone cell is a single tubular anode and a single tubular cathode. The tubular cells were also shown to be placed with other tubular cells in series. An electric source is applied between the anode and cathode of the ozone cells. The electric source on the anode and cathode creates an electric field that splits oxygen molecules in the ambient air, leaving two single, highly active atoms of oxygen that combine with other oxygen to produce ozone (O3). Ozone provides 50% more oxygen in its molecule, thereby providing faster and complete combustion, thereby providing more power to an engine.

While the foregoing devices to some extent may have accomplished their intended objectives, there is still a need to provide further improvement to the efficiency of an internal combustion engine. In particular, the prior art devices have not produced a sufficient volume of ozone (O3) to be effective. Without a way to improve combustion, the industry will continue to suffer from inefficiency and poor engine performance.

DISCLOSURE OF INVENTION

In accordance with the preferred embodiments, an apparatus is described to increase the efficiency and emissions of a combustion process by producing sufficient amounts of ozone in the air flow to the combustion chamber to enable more complete and cleaner combustion of the fuel. Embodiments of the invention include a plurality of cell elements disposed within a housing that is placed in the air intake to a combustion chamber such as a diesel engine. The plurality of cell elements create an electrical plasma field that produces ozone.

Preferred embodiments include a low frequency, lower voltage drive to the electrodes of the ozone elements. The lower frequency and voltage keep the ozone elements within a few degrees above ambient air temperature which produces a productive corona or plasma field for increased ozone available to the combustion chamber compared to prior art ozone generator cells.

Other embodiments include a scrubber in the housing to cause the air flow to have a vortex action to increase the amount of ozone that flows into the combustion chamber.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The preferred embodiments herein provide an apparatus to increase the efficiency and emissions of a combustion process by producing sufficient amounts of ozone in the air flow to the combustion chamber to provide more complete and cleaner combustion of the fuel. In preferred embodiments, a plurality of cell elements are disposed within a housing that is in placed in the air intake to a combustion chamber such as a diesel engine.

Figure 1:
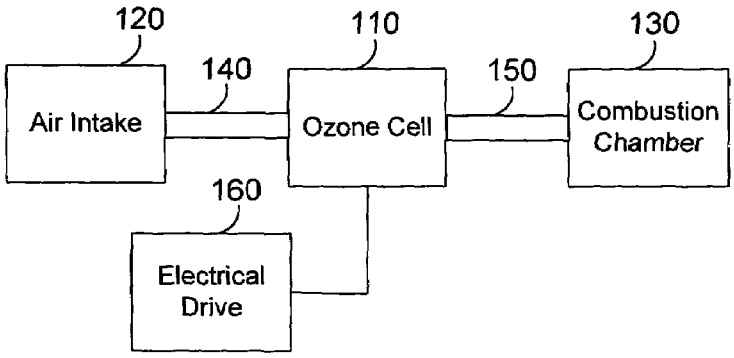
FIG. 1 (Prior Art)
FIG. 1 is a block diagram of an apparatus in accordance with the prior art for providing ozone to a combustion chamber.
Figure 2:
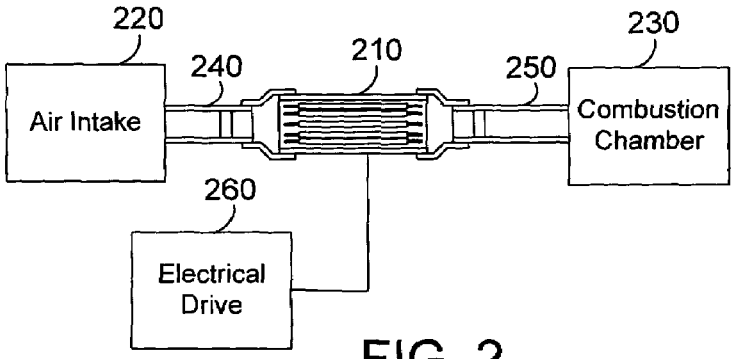
FIG. 2 is system view of an apparatus in accordance with preferred embodiments for providing ozone to a combustion chamber.

FIG. 2 shows an ozone cell 210 used to enhance the efficiency of combustion according to embodiments of the present invention. In FIG. 2, an ozone cell 210 is suitably disposed between an air intake 220 and a combustion chamber 230 to produce ozone and induce a charge in the air supply of a combustion process. In preferred embodiments the combustion process is an internal combustion engine such as a diesel truck engine. Other embodiments include other types of gasoline combustion engines such as used in automobiles. The claimed invention can also be used with other combustion processes such as electric power generation, furnaces, water heaters, or virtually any other combustion process.

Again referring to FIG. 2, the ozone cell 210 is connected in the supply line 240 from the air intake and connected to the combustion chamber 230 with a supply line 250. The ozone cell can be mounted in any suitable configuration and could be could be located at a convenient position which allows the gaseous output to be transmitted to the combustion chamber 230 by a supply line 250. The ozone cell 210 is energized by an electrical drive circuit 260, which is described further below with reference to FIG. 12.

Figure 3:
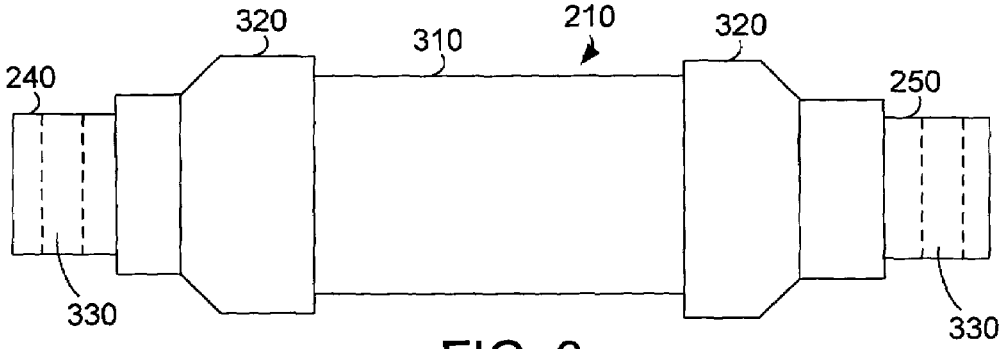
FIG. 3 is an apparatus in accordance with preferred embodiments for providing ozone to a combustion chamber.

FIG. 3 shows an external view of the ozone cell 210. In preferred embodiments, the ozone cell 210 includes a central housing 310 that may comprise a 4 inch pipe of PVC or similar material. The central housing 310 and the supply line 250 must be capable of carrying ozone gas and charged air without excessive deterioration. For example, PVC, neoprene or other inert material could be used. The central housing 310 is preferably larger in diameter than the supply lines 240, 250 so that the addition of cell elements (not shown and described below) will not significantly restrict air flow through the ozone cell 210. In the illustrated embodiment, the central housing is connected to supply lines 240, 250 with 4" to 3" couplings 320. FIG. 3 further illustrates the location of a scrubber vortex 330 disposed in each of supply lines 240 and 250. Further detail of the scrubber vortex is shown in FIG. 5 and described in the related text below.

Figure 4:
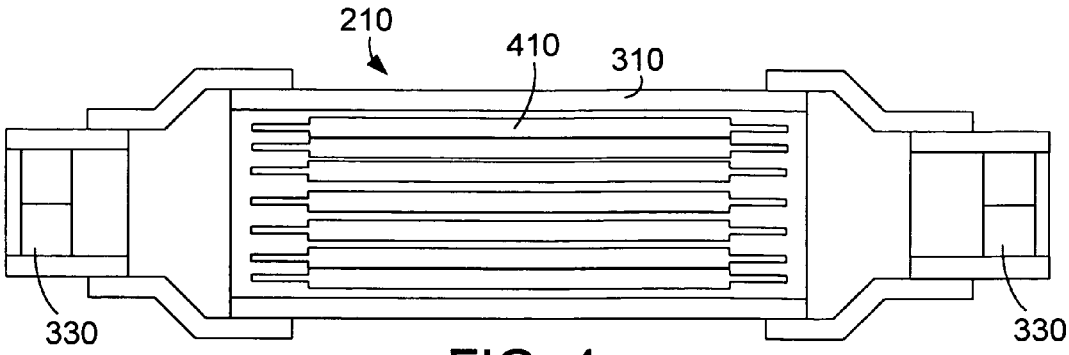
FIG. 4 is a cross-sectional view of an ozone cell in accordance with preferred embodiments for providing ozone to a combustion chamber.

FIG. 4 shows a cross-sectional view of the ozone cell 210. In preferred embodiments, the ozone cell 210 includes an arrangement of multiple ozone elements 410 within the housing. The arrangement of the ozone elements within the housing is described further below in conjunction with FIG. 8 and FIG. 11. The ozone elements are cylindrical in shape and run nearly the length of the housing. The overall length of the ozone elements can vary depending on the application.

Figure 5:
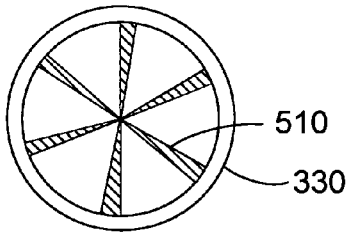
FIG. 5 is a scrubber vortex apparatus in accordance with preferred embodiments.

FIG. 5 illustrates the scrubber vortex 330 as viewed from the end of the ozone cell 210. In the illustrated preferred embodiment, the scrubber vortex 330 comprises six fins 510 equally spaced in the supply lines 240, 250. The fins 510 are bent to have a propeller like shape to disturb the air flow and cause the air to have turbulence. The turbulent air flow was found to increase the available ozone exiting the ozone cell 210. The air turbulence increases the exchange of fresh air at the surface of the ozone cell with the ozone containing air. It appears the increased ozone production is due to increased air being exposed to the ozone cell's plasma field.

Figure 6:
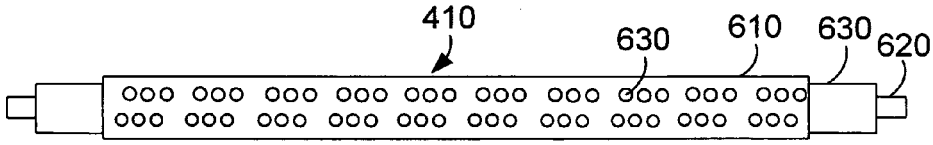
FIG. 6 is an ozone element in accordance with preferred embodiments.
Figure 7:
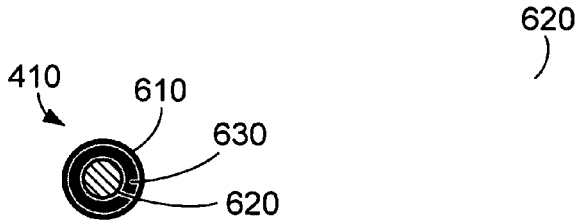
FIG. 7 is an end view of the ozone element shown in FIG. 6 in accordance with preferred embodiments.

Referring now to FIGS. 6 and 7, additional details of ozone element 410 will be described. The ozone element primarily comprises two conductive electrodes separated by an insulator. In the preferred embodiment shown in FIG. 6 and FIG. 7, an outer electrode 610 is separated from an inner electrode 620 by insulator 630. The insulator 630 extends beyond the outer electrode a distance sufficient to insure the voltage potential on the electrodes does not cause an arc between the electrodes. In preferred embodiments the insulator 630 extends about one and one-half inches past the outer electrode 610 on the surface of the inner electrode 620, as shown in FIG. 6.

Again referring to FIG. 6, insulator 630 is visible through a pattern of openings in the outer electrode 610. The openings in the outer electrode 610 provide air turbulence at the electrode surface to provide additional air contact with the electrode surface to increase the production of ozone and therefore the amount of ozone available to the combustion chamber. The inner electrode and the outer electrode can be made of variety of materials as is known in the prior art. In the preferred embodiment, the electrodes are made of stainless steel. The insulator can also be formed from a variety of materials. In this illustrated embodiment, the insulator is made of a non-conductive ceramic material.

Figure 8:
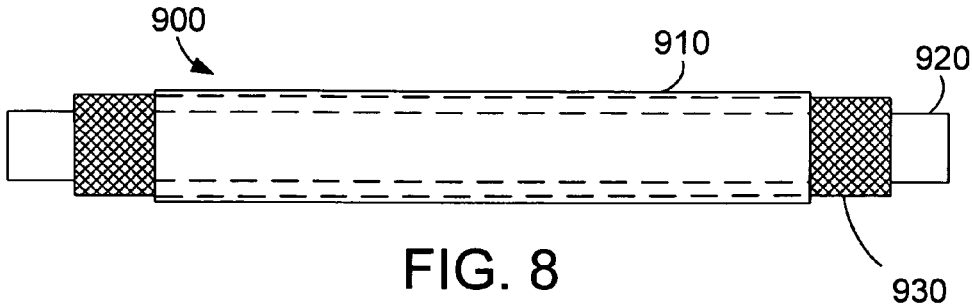
FIG. 8 is a lateral cross section view of another ozone element in accordance with preferred embodiments.
Figure 9:
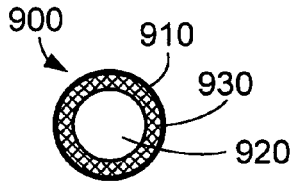
FIG. 9 is an end view of the ozone element shown in FIG. 8.

FIGS. 8 and 9 illustrate an ozone element 900 according to another preferred embodiment. The ozone element similarly comprises two conductive electrodes separated by an insulator. In this preferred embodiment, an outer electrode 910 is separated from an inner electrode 920 by insulator 930. In contrast to the previous embodiment, in this embodiment the inner electrode 920 is hollow or made of a open pipe as illustrated in FIG. 9. The open inner electrode 920 allows increased air flow through the ozone cell 210 (FIG. 2) and increased air flow in and around the ozone element 910 to increase the production of ozone by the ozone cell 210. In this embodiment, the outer electrode and inner electrode are preferably made of ⅝ inch and ½ inch pipe respectively. Further, in this embodiment, the inner electrode is made of a stainless steel pipe coated in polypropylene that is inserted in a second stainless steel pipe. Other insulators could also be used such as polyethylene, PVC or other insulators as used in the prior art.

It is important to note that the ozone elements in the illustrative embodiments do not have space for air to flow directly between the electrodes. Prior art ozone generator cells typically relied on air flow between the electrodes. This prior art method could be used in conjunction with the illustrated embodiments herein. However, tests have shown a significant increase in ozone production over prior art designs using the illustrated electrode configuration where air flows on both the outside surfaces of the electrodes rather than the space directly between the electrodes, particularly when used in conjunction with the other features of the described embodiments.

Figure 10:
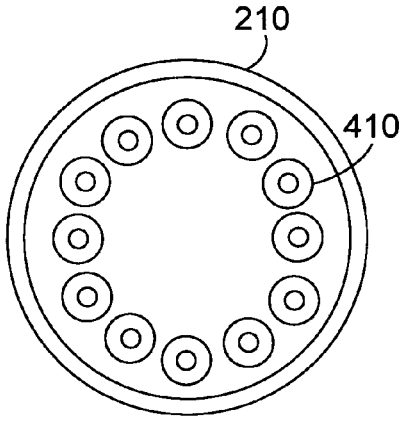
FIG. 10 is an end view of an ozone cell in accordance with preferred embodiments.

FIG. 10 illustrates an end view of an ozone cell 210 according to a preferred embodiment. This embodiment has multiple ozone elements 410 arranged in a concentric circle pattern inside the ozone cell 210. The number of ozone elements can vary depending on the specific application and the size of the ozone cell housing. The pattern of ozone elements allows for the formation of a plasma field around each of the ozone elements and between the ozone elements.

Figure 11:
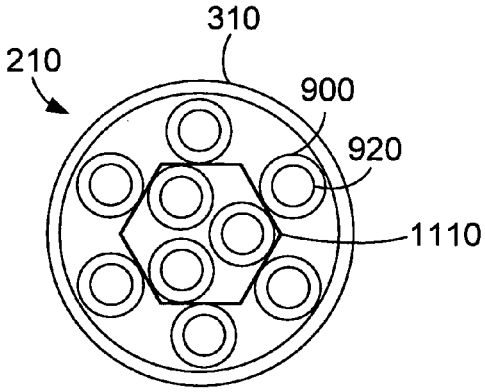
FIG. 11 is an end view of another ozone cell in accordance with preferred embodiments.

FIG. 11 illustrates an end view of an open ozone cell 210 according to another preferred embodiment. This embodiment also has multiple ozone elements 900 arranged in a concentric circle pattern inside the ozone cell housing 310. In addition to the concentric pattern, the ozone elements are placed tangent to a bonding spacer 1110 that is formed in the shape of a polygon such as a hexagon. The bonding spacer 1110 is preferably formed of a sheet of metal formed into a polygon. The bonding spacer 1110 is used to attached the ozone elements together in a spaced arrangement inside the ozone cell 310. The bonding spacer in the preferred embodiments is also used to provide an electrical connection to all the ozone elements as described below with reference to FIG. 12. Further, in this embodiment, another set of ozone elements are placed within the concentric circle of the first set of elements, and within the polygon. The number of ozone elements can vary depending on the specific application and the size of the ozone cell housing and the polygon used for the bonding spacer 1110. This dual pattern of ozone elements allows for the formation of a plasma field around each of the ozone elements and between the ozone elements, and allows for additional ozone elements to be placed within a specific diameter of ozone cell housing 310. This embodiment is shown with the ozone cells described with reference to FIGS. 8 and 9 where the ozone elements 900 have an open center electrode to increase the amount of air flow through the ozone cell 210.

Figure 12:
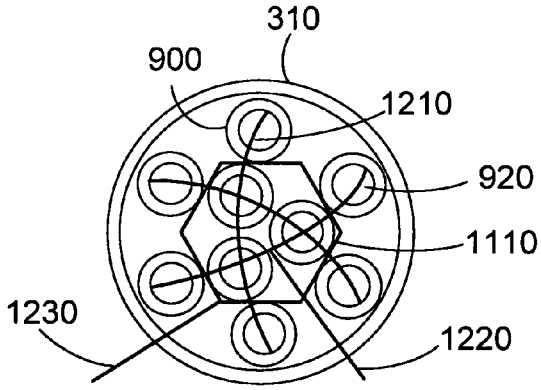
FIG. 12 is an end view of another ozone cell in accordance with preferred embodiments.

FIG. 12 illustrates electrical connections that are made inside the ozone cell 310 to the ozone elements 900. As introduced above, the bonding spacer 1110 in the preferred embodiments provides an electrical connection to all the ozone elements. Each of the ozone element's outer electrode is welded or otherwise electrically connected to the bonding spacer 1110. An electrical connection 1230 penetrates through the housing 310 and connects to the ozone spacer 1110. The electrical circuit 250 provides the drive voltage to the ozone element's outer electrode using the electrical connection 1230.

Figure 13:
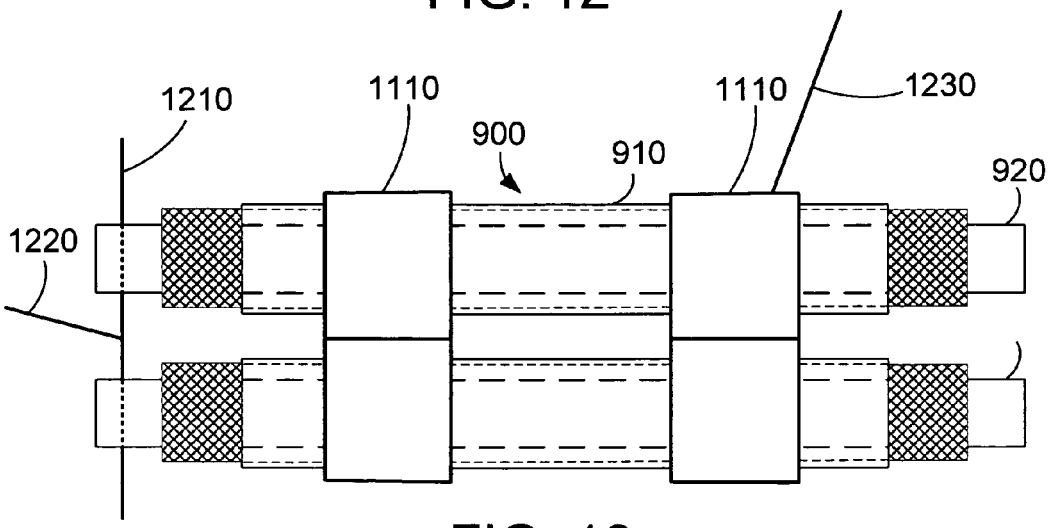
FIG. 13 is a view of two ozone elements that shows the electrical connections to the ozone elements in accordance with preferred embodiments.

FIGS. 12 and 13 further illustrate an electrical connection to the inner electrodes 920 of the ozone elements 900. In the illustrated embodiment, electrical connections to the inner electrodes 920 of each of the ozone elements 900 is accomplished by a set of interconnecting wires or rods 1210 that are connected in a suitable pattern. In this embodiment, the arc shaped wire 1210 penetrates four adjacent ozone elements. Each of the arc shaped wires 1210 are preferably connected at the intersection points so that a single connection wire 1220 can connect all the inner electrodes 920 to the electrical circuit 250. The location of the connection wire passing through the cell housing 310 is sealed to preserve the integrity of the cell housing 310. Combining the electrical connections in this manner helps reduce the amount of wiring inside the ozone cell 210 and provides a single connection outside the ozone cell 210 for each of the sets of inner and outer electrodes on the ozone elements 900.

FIG. 13 illustrates further detail of the electrical connections to the ozone elements 900. FIG. 13 is a side view of two ozone elements 900. Electrical connection 1220 is shown to connect to arc shaped wire 1210. The arc shaped wire passes through the extended end of the inner electrode 920 and makes an electrical contact with the inner electrode. The electrical connection 1230 that connects the electrical circuit to the outer electrodes 910 of the ozone elements 900 is also shown. The electrical connection 1230 connects to the bonding spacer 1110 that connects to the outer electrode 910 of each ozone element 900. In this embodiment, there are two bonding spacers 1110, one at each end of the ozone element. Of course, a single bonding spacer could also be used.

Figure 14:
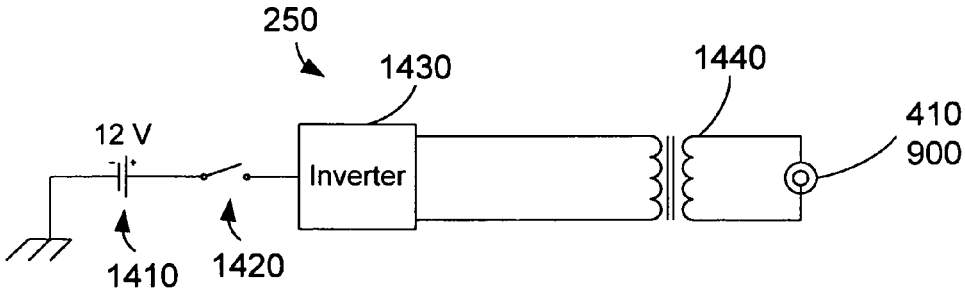
FIG. 14 is a schematic diagram of an electrical drive circuit in accordance with preferred embodiments.

FIG. 14 shows further details of the electrical drive circuit 250 introduced in the discussion of FIG. 2. The electrical drive circuit 250 for the ozone cells includes a battery such as a standard rechargeable twelve volt lead-acid battery of the type usually associated with internal combustion engines. In an automotive applications the battery can be the same as the one equipped on the vehicle since the current draw of the drive circuit 250 is minimal. The current from the battery 1410 is connected through a switch 1420 to an inverter 1430 which converts the electrical output of the battery 1410 to an AC voltage, at approximately 60 hertz. The output of the inverter 1430 is connected to a transformer 1440. A suitable transformer for use in connection with the present invention is described further below. In a preferred embodiment, the transformer 1440 boosts the voltage to approximately 8,000 VAC. The secondary winding of the transformer 1440 is connected to the ozone elements 410, 900 as described above.

Tests by the inventor herein indicate that a reduced temperature of the ozone cell increases the amount of ozone available to the combustion chamber. Tests indicated that a low frequency in combination with a lower voltage keeps the ozone elements within only a few degrees above ambient air temperature which produces a productive corona or plasma field for increased ozone available to the combustion chamber compared to prior art ozone generator cells. In the preferred embodiments the increase in the air temperature is less than 10 degrees, and in the most preferred embodiments, the increase in the air temperature is less than 5 degrees. The voltage of the preferred embodiments is from about 6,000 volts to about 12,000 volts AC. The most preferred embodiments use a voltage of about 8,000 volts AC. The preferred frequency is about 60 to 1000 Hz, with the most preferred frequency about 60 Hz.

In a preferred embodiment, the transformer is an oil filled, iron core transformer with copper wrap coils, that has the following electrical characteristics:

Input: 120 vac/60 hz output: 8 kvac/27 ma

Max Pri Va 260

Max Pri Watts 125

Open Sec KvRMS 8

Short Sec Ma 27

Tests of actual embodiments on a 1996 CHEVROLET SUBURBAN with 205,000 miles have show an increase in power, a reduction in polluting exhaust and increased fuel mileage of 34% or more. In a smog test on the equipped vehicle, unburned hydrocarbons were zero, poisonous carbon monoxide (CO) was zero, Nitrogen Oxides were almost zero. The test engine was observed to have a significant increase in power.

On another test done on a Cummins ISX diesel engine in a 2002 International Eagle diesel truck hauling a 43,000 lb. load, the results were as follows:

4.5 mpg before, 6.71 mpg after, exhaust temperature dropped from 7 to 3, and turbo boost dropped from 36 to 12.

On the same truck, overall average mpg before was in the low 5 mpg range and after installation of the device the truck runs in the high 7 mpg range. Further, there is no black smoke produced from the exhaust pipes as was normal prior to installation of the device.

The present invention as described with reference to the preferred embodiments provides significant improvements over the prior art. An apparatus and method was described that increases combustion efficiency and performance and lowers emissions of virtually any combustion process. Embodiments herein provide improved efficiency and performance and lower emissions in an internal combustion engine such as a diesel truck engine.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention.

What is claimed is:

1. An apparatus for increasing the efficiency of combustion comprising:

a housing adapted to be disposed between an air intake and a combustion chamber to supply air to the combustion chamber through the housing;

a plurality of adjacent cylindrical ozone elements arranged in the housing for creating a plasma field in the housing around and between the ozone elements; and a vortex scrubber in the housing to produce a vortex motion of air moving through the housing.

2. The apparatus of claim 1 further comprising an electrical circuit that applies a low frequency AC drive voltage to the ozone elements to provide a low temperature plasma field that does not substantially increase the ambient air temperature.

3. The apparatus of claim 2 wherein the low frequency AC drive voltage is about 8,000 volts AC and the increase in the ambient air temperature is less than 5 degrees F.

4. The apparatus of claim 1 wherein the ozone elements are arranged in a concentric circle inside the housing.

5. The apparatus of claim 1 wherein a first plurality of the ozone elements are arranged in a first pattern inside the housing and a second plurality of ozone elements are located inside the first pattern of ozone elements.

6. The apparatus of claim 5 wherein the first plurality of the ozone elements are arranged in a hexagonal pattern.

7. The apparatus of claim 1 wherein the combustion chamber is the cylinder of a combustion engine.

8. The apparatus of claim 1 wherein the combustion chamber is the cylinder of a diesel engine.

9. The apparatus of claim 1 wherein the vortex scrubber in the housing comprises a plurality of fins radially disposed from the center of the housing to the inner edges of the housing.

10. The apparatus of claim 1 wherein the ozone elements comprise an inner electrode of conductive material and an outer electrode of conductive material separated by an insulator.

11. The apparatus of claim 10 wherein the inner electrode and the outer electrode form an anode and cathode, respectively made of stainless steel.

12. The apparatus of claim 10 wherein the insulator is made of a ceramic material.

13. The apparatus of claim 10 wherein the outer electrode is perforated with a pattern of holes.

14. The apparatus of claim 10 wherein the inner electrode is a pipe that allows air to flow through the center of the ozone element.

15. The apparatus of claim 1 wherein the housing comprises a PVC pipe.

16. An apparatus for increasing the efficiency of a combustion engine comprising:

a housing adapted to be disposed between an air intake and a combustion chamber of the combustion engine to supply air to the combustion chamber through the housing;

a plurality of adjacent cylindrical ozone elements arranged in the housing for creating a plasma field in the housing around and between the ozone elements, and wherein the ozone elements comprise an inner electrode of conductive material and an outer electrode of conductive material separated by an insulator; and substantially an entire inner surface of the outer electrode is in direct contact with the insulator and substantially an entire outer surface of the inner electrode is in direct contact with the insulator to allow air flow on the outer surface of the outer electrode and prevent air flow between the electrodes.

17. The apparatus of claim 16 wherein the inner electrode is a pipe that allows air to flow through the center of the ozone element on an inner surface of the inner electrode.

18. The apparatus of claim 16 further comprising a vortex scrubber in the housing comprising a plurality of fins radially disposed from the center of the housing to the inner edges of the housing to produce a vortex motion of air moving through the housing.

19. The apparatus of claim 16 wherein the ozone elements are arranged in a concentric circle inside the housing.

20. The apparatus of claim 16 wherein a first plurality of the ozone elements are arranged in a first pattern inside the housing and a second plurality of ozone elements are located inside the first pattern of ozone elements.

21. An apparatus for increasing the efficiency of a combustion engine comprising:

a housing adapted to be disposed between an air intake and a combustion chamber of the combustion engine to supply air to the combustion chamber through the housing;

a first and second plurality of adjacent cylindrical ozone elements arranged in the housing for creating a plasma field in the housing wherein the first plurality of the ozone elements are arranged in a first pattern inside the housing and the second plurality of ozone elements are located inside the first pattern of ozone elements; and a bonding spacer between the first and second plurality of ozone elements that electrically connects to an outer electrode of the ozone elements.

22. The apparatus of claim 21 further comprising an electrical circuit that applies a low frequency AC drive voltage to the ozone elements to provide a low temperature plasma field that does not substantially increase the ambient air temperature and wherein the drive voltage is about 6,000 to 12,000 volts AC.

23. The apparatus of claim 22 wherein the drive voltage is about 8,000 volts AC and wherein a low temperature plasma field increases the ambient air temperature no more than 10 degrees.

24. The apparatus of claim 21 wherein the bonding spacer is polygon shaped.

25. The apparatus of claim 21 wherein the plurality of ozone elements have an outer electrode with a pattern of openings to provide air turbulence at the electrode surface.

26. The apparatus of claim 16 wherein the outer electrode of the plurality of electrodes have a pattern of openings to provide air turbulence at the electrode surface.

* * * * *